US008901854B1

(12) United States Patent
Chiu et al.

(10) Patent No.: US 8,901,854 B1
(45) Date of Patent: Dec. 2, 2014

(54) MULTI-SEGMENT LED DRIVING CIRCUIT

(71) Applicant: Anwell Semiconductor Corp., Hsin-Chu (TW)

(72) Inventors: Shao-Wei Chiu, Hsin-Chu (TW); Chun-Chieh Kuo, Hsin-Chu (TW); Cheng-Po Hsiao, Hsin-Chu (TW); Shih-Ping Tu, Hsin-Chu (TW)

(73) Assignee: Anwell Semiconductor Corp., Hsin-Chu (TW)

( * ) Notice: Subject to any disclaimer, the term of this patent is extended or adjusted under 35 U.S.C. 154(b) by 49 days.

(21) Appl. No.: 13/889,535

(22) Filed: May 8, 2013

(51) Int. Cl.
*H05B 33/08* (2006.01)

(52) U.S. Cl.
CPC ..... *H05B 33/0821* (2013.01); *H05B 33/0824* (2013.01)
USPC ..... 315/308; 315/185 R; 315/224; 315/307

(58) Field of Classification Search
USPC ..... 315/307, 308, 291, 185 R, 193, 186, 224
See application file for complete search history.

(56) References Cited

U.S. PATENT DOCUMENTS

| | | | | |
|---|---|---|---|---|
| 7,999,486 | B2 * | 8/2011 | Wang et al. | 315/291 |
| 8,106,604 | B2 * | 1/2012 | Zhao et al. | 315/299 |
| 8,358,084 | B2 * | 1/2013 | Shiu et al. | 315/291 |

* cited by examiner

*Primary Examiner* — David H Vu
(74) *Attorney, Agent, or Firm* — Rosenberg, Klein & Lee

(57) ABSTRACT

Disclosed is a multi-segment LED driving circuit used in an AC operating mode for outputting a drive current to drive a plurality of serially connected LED strings. The LED driving circuit includes at least one detection part, at least one comparison part and at least one adjusting part. The detection part detects an input voltage and an output voltage at both ends of each string and its next string to form a detected value provided for the comparison part to compare the detected value with a reference value to turn on or off the adjusting part so as to control the strings through which the drive current passes and then sequentially drives the strings to emit light. The LED driving circuit can adjust the load of the circuit immediately based on the change of voltage value of the AC power to ensure the stability of the drive current.

9 Claims, 7 Drawing Sheets

MULTI-SEGMENT LED DRIVING CIRCUIT

BACKGROUND OF THE INVENTION

1. Field of the Invention

The present invention relates to the field of light emitting diode (LED) power source device, and more particularly to a multi-segment LED driving circuit that adjusts the operating status of each LED string according to a change of voltage value of an AC input voltage to achieve the effects of high energy conversion efficiency and high light utilization.

2. Description of the Related Art

After LED hits the market by its features of low power consumption and high performance, it is a main subject for related manufacturers to find a way of controlling the illumination brightness, operating efficiency and service life of LED lamps. At present, most LED lamps adopt a control circuit with a constant current architecture, and the LEDs are serially connected to an N-type metal oxide semiconductor field effect transistor (N-MOSFET) and a current resistor to restrict a constant drive current passing through the LEDs by the current resistor. The current resistor receives the drive current and has a voltage drop value formed at both ends of the current resistor and fed back to an operational amplifier. After the operational amplifier compares the voltage drop value with a reference voltage value, a negative feedback circuit formed by connecting the operational amplifier, the N-MOSFET and the current resistor is provided for stepping down the voltage at both ends of the current resistor and maintaining the voltage constant and equal to the reference voltage value, so as to maintain the drive current at a constant status. In the meantime, the total harmonic distortion (THD) is restricted within a range to facilitate selling the product to markets at different places.

However, not all of the AC voltages used in different countries are the same, and the drive current and the THD also varies with the change of voltage value of the AC voltage. The greater the output power, the higher is the level of difficulty of controlling the THD within a range stably. As a result, the product quality is unstable and the product cannot be introduced into some of the markets, and the economic values and benefits are reduced. Now, if safety components are installed additionally to stabilize the THD, the cost of the lamps will be increased and unfavorable for the economic benefits.

Therefore, it is a main subject of the present invention to drive a corresponding quantity of LED strings according to the voltage change of the inputted AC current under the application condition of connecting the LEDs in series with one another to stabilize the operation quality and THD, while reducing the unnecessary power consumption and lowering the operating temperature of the overall circuit.

SUMMARY OF THE INVENTION

It is a primary objective of the present invention to provide a multi-segment LED driving circuit with a simple architecture, wherein a single set of constant current control circuit is connected in series with a plurality of LED strings for controlling the LED strings and adjusting the operating status of each LED string based on a change of a voltage value of an external AC power to ensure the overall circuit being operated in a constant current mode, and stabilize the operation quality as well as the service life of the circuit.

To achieve the aforementioned objectives, the present invention provides a multi-segment LED driving circuit used in an AC operating mode for driving a plurality of LEDs to ensure a constant current value of a drive current passing through the LEDs, and the LEDs being divided into a plurality of strings, and having a node between every two adjacent strings, characterized in that the multi-segment LED driving circuit comprises at least one detection part, at least one comparison part and at least one adjusting part, and the detection part is electrically coupled to the strings, the comparison part is electrically coupled to the detection part and the adjusting part, and the adjusting part is electrically coupled to each string; and the detection part detects an input voltage and an output voltage at both ends of each and the next string thereof to form a detected value, and the comparison part compares an operating voltage value fed back by the adjusting part with a reference value to output a driving signal and adjust the adjusting part, so as to control the strings that the drive current is passed and then drive the LEDs to emit light.

Wherein, the multi-segment LED driving circuit further comprises a current resistor; the detection part is an AND gate, the comparison part is an operational amplifier; the adjusting part is an N-type metal oxide semiconductor field effect transistor (N-MOSFET); an input terminal of the AND gate is coupled to an input terminal of each string for receiving an input voltage of the string, and another input terminal of the AND gate is coupled to an output terminal of the next string of the string through an inverter for receiving an output voltage of the next string; and an output terminal of the AND gate is coupled to an enable terminal of the comparison part. A drain of the adjusting part is coupled to a node between each string and the next string thereof; a gate of the adjusting part is coupled to an output terminal of the comparison part; and a source of the adjusting part is coupled to a negative input terminal of the comparison part and the current resistor. In addition, a positive input terminal of the comparison part receives the reference value. Therefore, the aforementioned components constitute a negative feedback circuit architecture for receiving the drive current passing through each string to form the operating voltage value at both ends and then feeding back the operating voltage value to the operational amplifier. In the meantime, the negative and positive input terminals of the operational amplifier have the same voltage value as the reference value based on the physical property of the operational amplifier, so that the voltage value received by the current resistor is always maintained at the reference value to ensure that the drive current is a constant current value.

In summation, the present invention timely detects a change of the voltage value of an external AC power through the simple circuit architecture to adjust the load, so that the LED strings emit light sequentially from top to bottom to maintain a constant current value of the drive current and improve the overall service life and efficiency of the circuit. Persons having ordinary skills in the art should be able to know and achieve the aforementioned effect easily, and the detection part, the comparison part and the adjusting part can be combined directly into a control unit installed in the circuit, in addition being existed in form of separate electronic components. When the detection part, the comparison part and the adjusting part come with a plural quantity, the detection parts are sequentially and electrically coupled to an input terminal and an output terminal of the corresponding string and the next string of the string; and the adjusting parts are sequentially and electrically coupled to the output terminal of the corresponding string. Alternately, the detection part, the comparison part and the adjusting part are combined into a single chip unit which is installed in a control chip, and the control chips are connected in series with each other through a pair of corresponding expansion pins, so that the quantity of control chips can be increased or decreased according to the quantity of strings to meet the actual circuit requirements of the LED lamp and improve the industrial application and economic effect.

DETAILED DESCRIPTION OF THE PREFERRED EMBODIMENTS

The technical content of the present invention will become apparent with the detailed description of preferred embodiments and the illustration of related drawings as follows.

Figure 1:
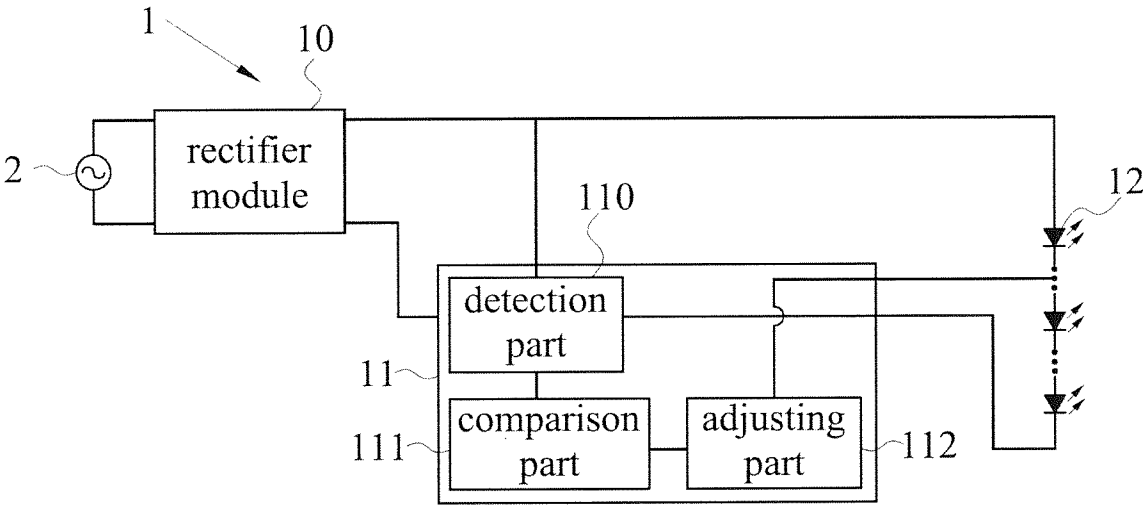
FIG. 1 is a block diagram of a preferred embodiment of the present invention.
Figure 2:
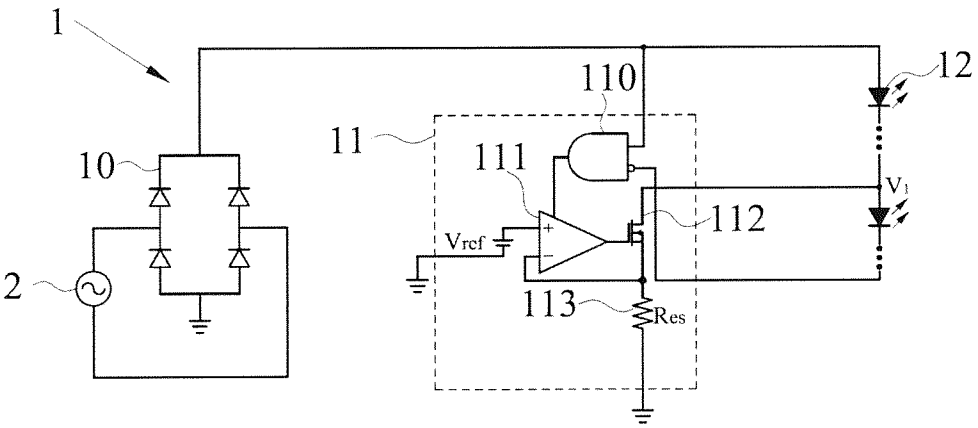
FIG. 2 is a circuit diagram of a first implementation mode of a preferred embodiment of the present invention.

With reference to FIGS. 1 and 2 for a block diagram and a circuit diagram of a multi-segment LED driving circuit in accordance with a preferred embodiment of the present invention respectively. The multi-segment LED driving circuit 1 comprises a rectifier module 10, a control module 11 and a plurality of LEDs 12, and the multi-segment LED driving circuit 1 is used in an AC operating mode for sequentially driving the LEDs 12 to emit light and ensuring a constant current value of a drive current passing through the LEDs 12. The LEDs 12 are divided into a plurality of strings, and a node is formed at a connection position between any two adjacent strings. For example, the LEDs 12 are divided sequentially from top to bottom into first and second strings, and a node (V1) is formed between the first and second strings. The rectifier circuit 10 can be a bridge rectifier coupled to an external power supply 2 and provided for rectifying an AC voltage into a variable DC voltage to be supplied to the control module 11 and the LEDs 12. The control module 11 has a detection part 110, a comparison part 111, an adjusting part 112 and a current resistor (Res) 113, wherein the detection part 110 is an AND gate, the comparison part 111 is an operational amplifier, and the adjusting part 112 is an N-MOSFET. An input terminal of the AND gate is coupled to an output terminal of the rectifier circuit 10 and an input terminal of the first string for receiving an input voltage of the string, and another input terminal of the AND gate is coupled to an output terminal of the next string of the string (which is the second string) through an inverter 1100 for receiving an output voltage of the next string, so that the detection part 110 detects an input voltage and an output voltage at both ends of each string and its next string to form a detected value. The N-MOSFET has a drain coupled to the node between each string and its next string, a gate coupled to an output terminal of the operational amplifier, and a source coupled to a negative input terminal of the operational amplifier and the current resistor 113 to constitute a negative feedback circuit architecture, so that the current resistor receives the drive current passing through each string to form an operating voltage value at both ends thereof. In addition, the positive input terminal of the comparison part 111 receives a reference value (Vref), and the enable terminal is coupled to an output terminal of the AND gate for comparing the operating voltage value fed back by the adjusting part 112 with the reference value when the detected value is received and then outputting a driving signal to adjust the adjusting part 112, so as to control the drive current passing through the quantity of strings and then sequentially drives the LEDs 12 to emit light.

Figure 3:
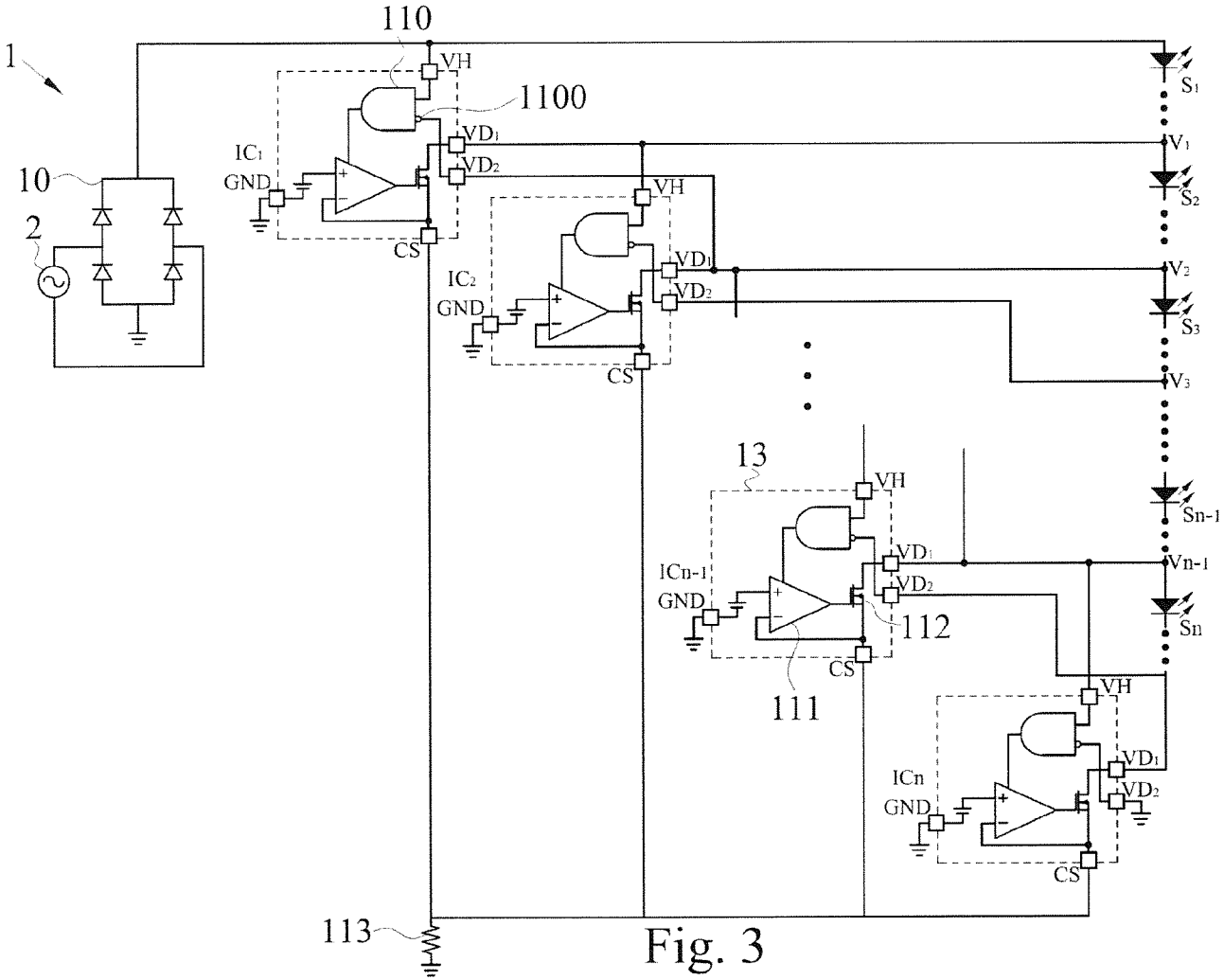
FIG. 3 is a circuit diagram of a second implementation mode of a preferred embodiment of the present invention.

With reference to FIG. 3 for a circuit diagram of a second implementation mode of a preferred embodiment of the present invention, the LEDs 12 are divided into $S_1$~$S_n$ strings, and nodes $V_1, V_2, V_3 \ldots V_{n-1}$ are formed between every two adjacent string $S_1$ and $S_2$, $S_2$ and $S_3$, $S_3$ and $S_4 \ldots S_{n-1}$ and $S_n$ respectively, and the detection part 110, the comparison part 111 and the adjusting part 112 are combined to form a control unit. For example, an IC with five pins VH, $VD_1$, $VD_2$, CS and GND is used in the circuit, so that the control module 11 comprises a control unit 13 having $IC_1$~$IC_n$ and the current resistor 113, and an input terminal of the AND gate of the $IC_1$ is coupled to an output terminal of the rectifier circuit 10 and an input terminal of the first string $S_1$ through the pin VH, and another input terminal the AND gate of the $IC_1$ is coupled to an output terminal of the second string $S_2$ which is the node $V_2$ in an opposition direction through the pin $VD_2$; the N-MOSFET has a drain coupled to the node $V_1$ through the $VD_1$ pin, a gate coupled to an output terminal of the operational amplifier, and a source coupled to a negative input terminal of the operational amplifier and coupled to the current resistor 113 through the pin CS. An input terminal of the AND gate of the $IC_2$ is coupled to an input terminal of the second string $S_2$ through the pin VH; in other words, the node $V_2$ is coupled to the pin $VD_1$ of the $IC_1$, and another input terminal the AND gate of the $IC_2$ is coupled to an output terminal of the third string $S_3$ which is the node $V_3$ in an opposite direction through the pin $VD_2$; and the N-MOSFET has a drain coupled to the node $V_2$ through the pin $VD_1$, a gate coupled to an output terminal of the operational amplifier, and a source coupled to a negative input terminal of the operational amplifier and coupled to the current resistor 113 through the pin CS, and so on. The detection parts 110 of the $IC_1$~$IC_n$ are sequentially and electrically coupled to an input terminal of the corresponding string and an output terminal of the next string of the string, and the adjusting parts 112 are sequentially and electrically coupled to an output terminal of the corresponding string.

When the external power supply 2 outputs 110 VAC, the voltage level rises from 0V with time (t) in a sine wave form, the $IC_1$ obtains appropriate electric energy from the pin VH to start the IC function, and the AND gate obtains a high-level voltage (1). If the voltage inputted by the external power supply 2 does not exceed the total operating critical voltage value of the two LED strings $S_1$ and $S_2$, the pin $VD_2$ will receive a low-level voltage (0). After the low-level voltage is inverted by the inverter 1100, the AND gate inputs the detected value of a high-level voltage to enable the driving signal of a high-level voltage outputted from the operational amplifier to conduct the adjusting part 112 and drive the LEDs 12 of the LED string $S_1$ to emit light, and the current resistor 113 is provided for controlling the drive current at a constant current value. If the voltage inputted by the external power supply 2 keeps rising and exceeds the total operating critical voltage value of the two LED strings $S_1$ and $S_2$, the LEDs 12 of the LED string $S_2$ will be conducted, and the pin VH of the $IC_2$ will obtain appropriate electric energy to start the IC function. Now, the drive current passing through $S_1$ is maintained at $V_{ref}/R_{cs}$, but the value of the current passing through the $S_2$ will be increased immediately thereafter, and the value of the current passing into the N-MOSFET of the $IC_1$ will be decreased. The drive current passing through the $S_2$ is increased gradually such that after the pin $VD_2$ of the $IC_1$ receives a high-level voltage (1), the $IC_1$ will turn off the adjusting part 112 immediately, so that the drive current passes through $S_1$ and $S_2$, and the current is still fixed to $V_{ref}/R_{cs}$. As the voltage inputted by the external power supply 2 keeps rising to drive $IC_n$ to operate and when the pin $VD_2$ of the $IC_{n-1}$ receives a high-level voltage (1), the drive current is a constant current $V_{ref}/R_{cs}$ passing through $S_1+S_2+S_3+\ldots+S_n$. As the voltage value of the external power supply 2 rises from 0V to 110√2V and the total operating critical voltage value of the LEDs 12 is smaller than 110√2V, the strings will conduct the $S_1$, $S_1+S_2$, . . . , $S_1+S_2+S_3+\ldots+S_n$ to emit light sequentially.

Figure 4:
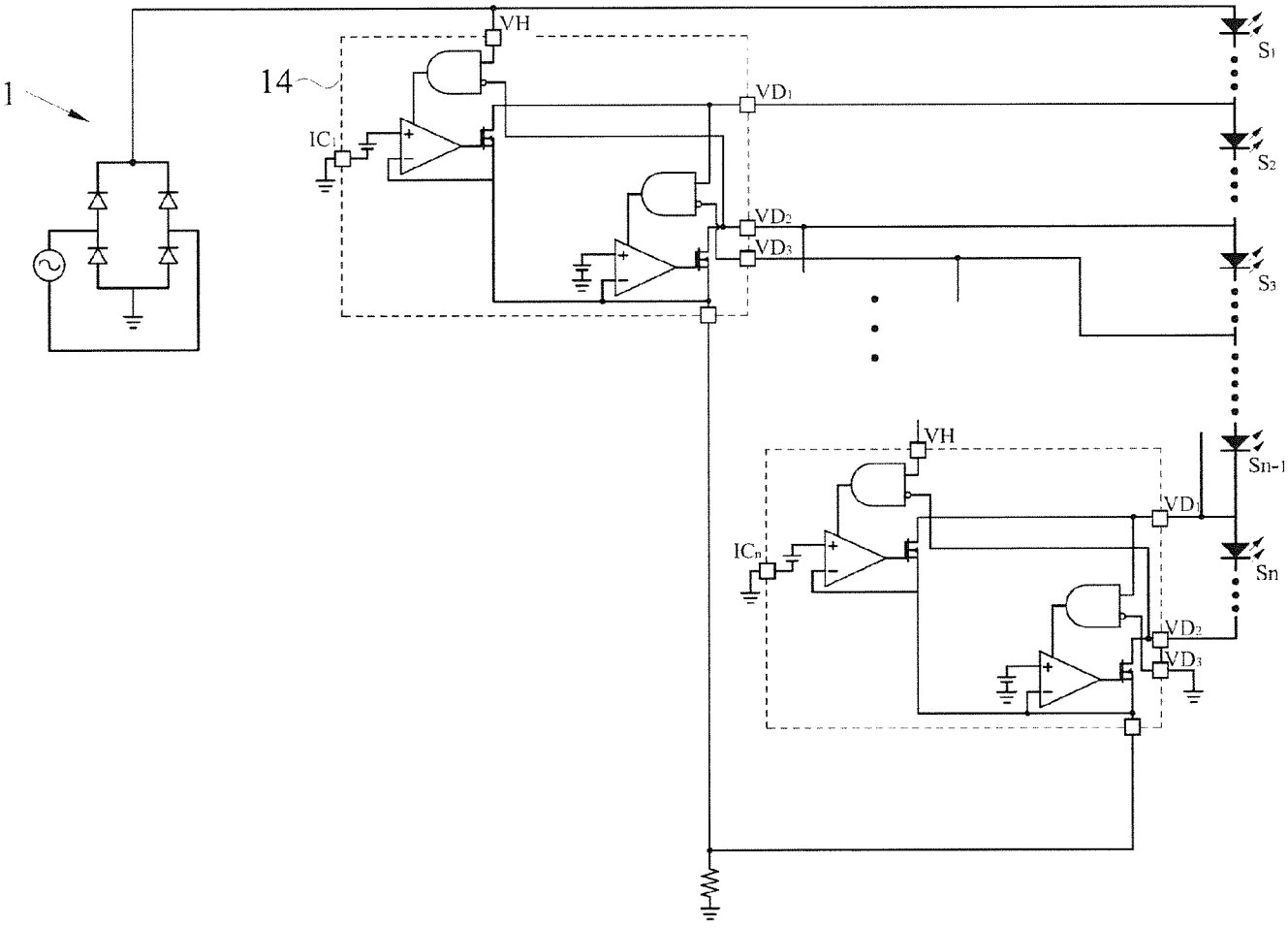
FIG. 4 is a circuit diagram of a third implementation mode of a preferred embodiment of the present invention.
Figure 5:
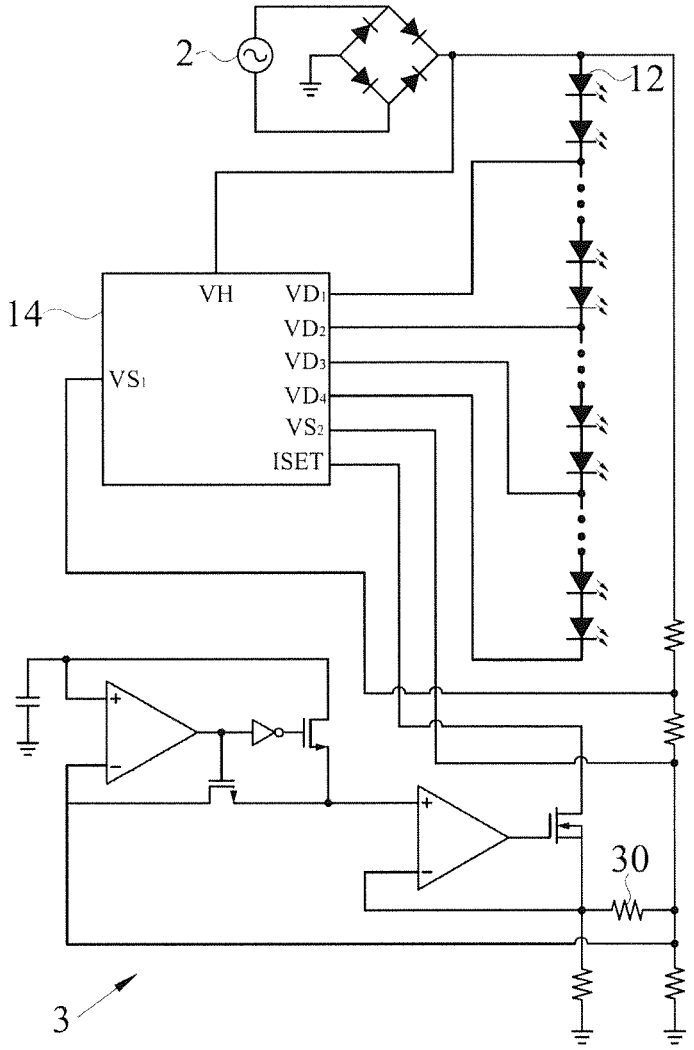
FIG. 5 is a circuit diagram of a fourth implementation mode of a preferred embodiment of the present invention.
Figure 6:
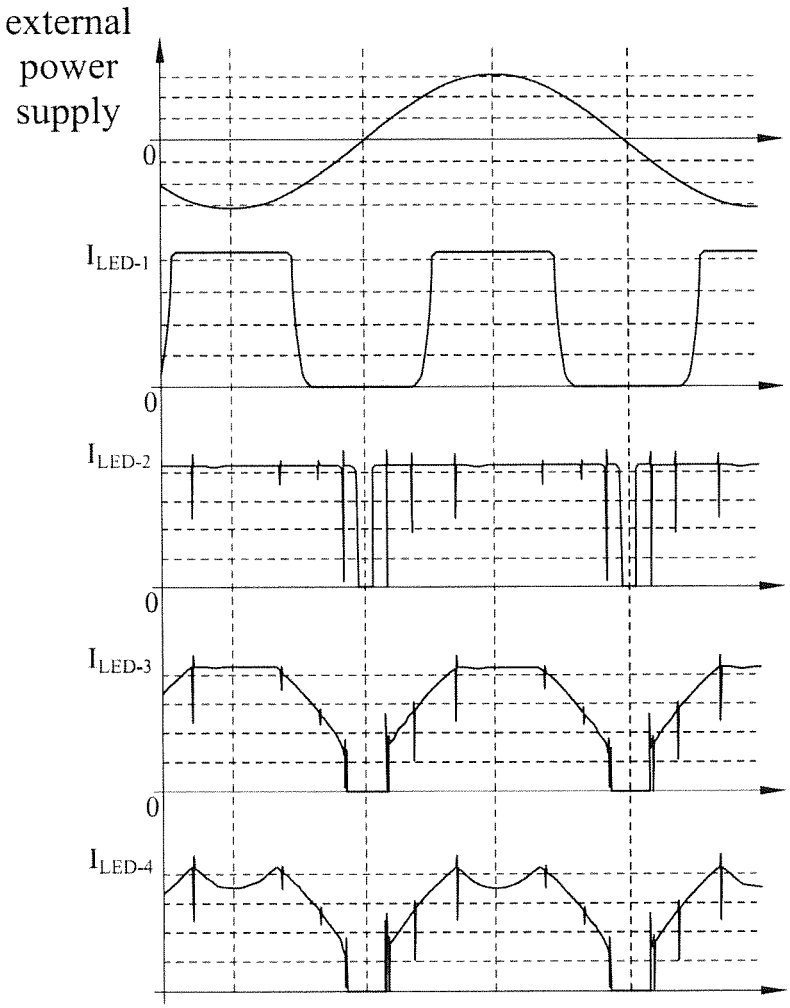
FIG. 6 is a waveform diagram of the fourth implementation mode of a preferred embodiment of the present invention.

In this preferred embodiment, the detection part 110, the comparison part 111 and the adjusting part 112 are combined into a single chip unit and integrated into a control chip 14. In FIG. 4, the control chip 14 having two chip units laid therein, so that a drain of a N-MOSFET of a chip unit is coupled to an input terminal of an AND gate of the other chip unit, and then coupled to a pin $VD_1$, and an input terminal of the AND gate of the chip unit is coupled to the pin VH, and the other input terminal of the AND gate is coupled to a drain of a N-MOSFET of the other chip unit and then coupled to a pin $VD_2$ pin, and a pin $VD_3$ is added for connecting another input terminal of an AND gate of the other chip unit. Alternatively, the control chip 14 includes three chip units installed therein and a plurality of pins $VD_1$~$VD_4$, and the control chip 14 is installed in a THD correction circuit 3 in an LED lamp as shown in FIG. 5 for controlling the LEDs 12 of the four strings to achieve the effect of increasing or decreasing the drive current with an AC voltage waveform of the external power supply 2, so as to reduce the THD of the linearly driven circuit of the LED lamp and increase the power factor (PF). The THD correction circuit 3 has a compensation resistor 30 with the actually measured signal waveform as shown in FIG. 6. The drive current (ILED_1) has a current waveform outputted by the LED lamp having the LEDs 12 in a string and without the THD correction circuit 3 and the compensation resistor 30. The drive current (ILED_2) has a current waveform outputted by the LED lamp having the LEDs 12 with four strings and without the THD correction circuit 3 and the compensation resistor 30. The drive current (ILED_3) has a current waveform outputted by the LED lamp having the LEDs 12 with four strings and the THD correction circuit 3 but without the compensation resistor 30. The drive current (ILED_4) has a current waveform outputted by the LED lamp having the LEDs 12 with four strings, the THD correction circuit 3 and the compensation resistor 30. We can observe that the conduction cycle of the ILED_1 is short and the current waveform does not change with the voltage waveform and has low THD and PF values. The conduction cycle of the ILED_2 is increased, but the current waveform still does not change with the voltage waveform, so that even the THD and PF values are improved, yet they are still not good enough. The conduction cycle of the ILED_3 is increased and the current waveform changes with the voltage waveform, so that the THD and PF values can be improved significantly. The conduction cycle of ILED_4 is increased, and the current waveform changes with the voltage waveform. In addition, the higher the voltage value of the external power supply, the greater is the current drop in the conduction cycle. Therefore, the LED lamp can achieve the effect of keeping the input power from being changed severely due to the increase of the input voltage. Therefore, the multi-segment LED driving circuit 1 increases the time for the drive current to be changed with the change of the external power supply 2, so as to ensure the THD value of the linearly driven circuit at a constant range.

Figure 7:
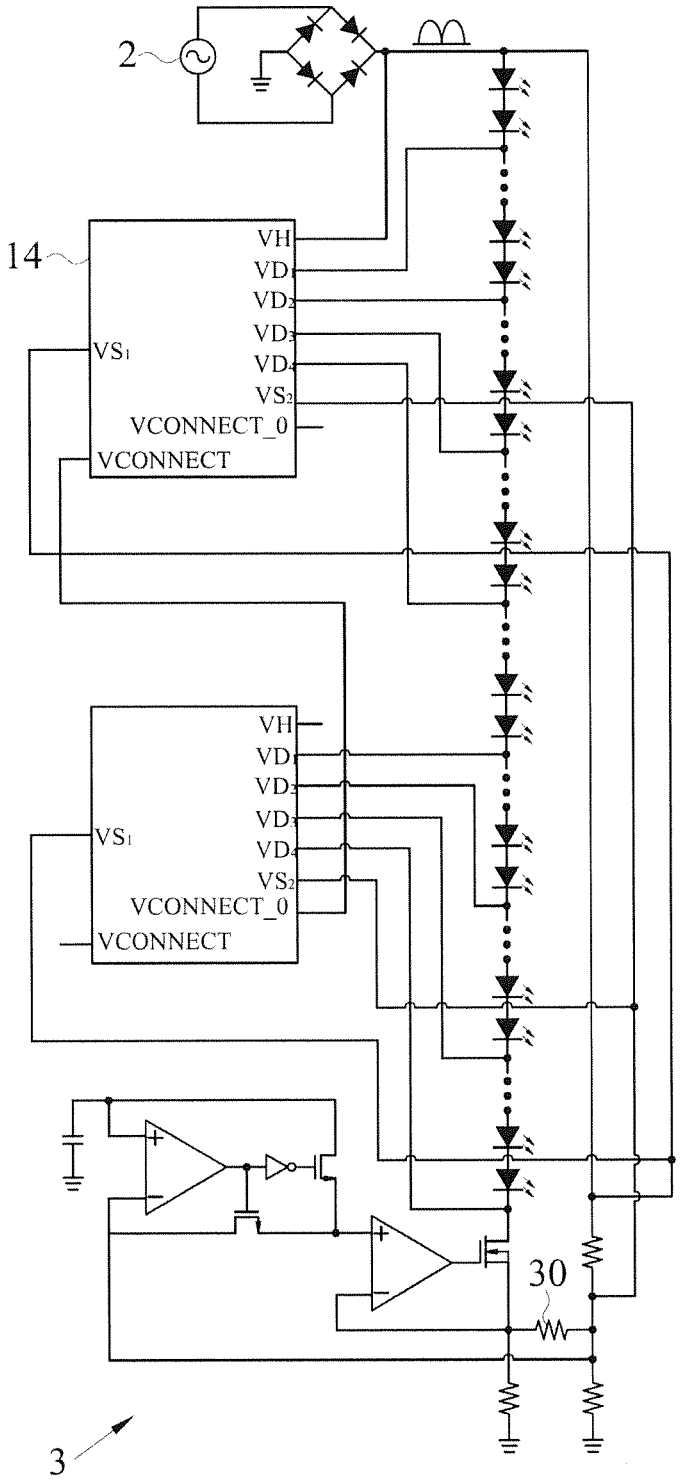
FIG. 7 is a circuit diagram of a fifth implementation mode of a preferred embodiment of the present invention.

It is noteworthy that if the quantity of LEDs 12 is increased as shown in FIG. 7 and divided into eight strings, the control module 11 can add another control chip 14 for coupling the newly added four strings, and the two chips can be connected in series with each other through the two pins VCONNECT_O and VCONNECT to simplify the assembly and facilitate the manufacture significantly.

What is claimed is:

1. A multi-segment LED driving circuit, used in an AC operating mode for driving a plurality of LEDs to ensure a constant current value of a drive current passing through the LEDs, and the LEDs being divided into a plurality of strings, and having a node between every two adjacent strings, characterized in that:

the multi-segment LED driving circuit comprises at least one detection part, at least one comparison part and at least one adjusting part, and the detection part is electrically coupled to the strings, the comparison part is electrically coupled to the detection part and the adjusting part, and the adjusting part is electrically coupled to each string; the detection part detects an input voltage and an output voltage at both ends of each and the next string thereof to form a detected value, and the comparison part is enabled to compare an operating voltage value fed back by the adjusting part with a reference value to output a driving signal and adjust the adjusting part, so as to control the strings that the drive current passes, and then sequentially drive the LEDs to emit light.

2. The multi-segment LED driving circuit of claim 1, wherein the detection part is an AND gate having an input terminal coupled to an input terminal of each string for receiving an input voltage of the string, and another input terminal coupled to an output terminal of a next string of a string through an inverter for receiving an output voltage of the next string, and the AND gate has an output terminal electrically coupled to a trigger terminal of the comparison part.

3. The multi-segment LED driving circuit of claim 2, wherein the comparison part is an operational amplifier having a positive input terminal for receiving the reference value, a negative input terminal electrically coupled to an output terminal of the adjusting part, and an output terminal electrically coupled to a trigger terminal of the adjusting part, and an enable terminal of the operational amplifier is coupled to an output terminal of the AND gate.

4. The multi-segment LED driving circuit of claim 3, wherein the adjusting part is an N-type metal oxide semiconductor field-effect transistor (N-MOSFET) having a drain coupled to the node between each string and a next string thereof, a gate coupled to an output terminal of the operational amplifier, and a source coupled to a negative input terminal of the operational amplifier to constitute a negative feedback circuit architecture to provide a stable current control.

5. The multi-segment LED driving circuit of claim 4, further comprising a current resistor coupled to the source of the N-MOSFET for receiving the drive current passing through each string to form the operating voltage value at both ends thereof.

6. The multi-segment LED driving circuit of claim 1, wherein if the detection part, the comparison part and the adjusting part come with a plural quantity, the detection parts are sequentially and electrically coupled to the input terminals and the output terminals at both ends of the corresponding strings and the next strings thereof, and the adjusting parts are sequentially and electrically coupled to the output terminals of the corresponding strings.

7. A multi-segment LED driving circuit, used in an AC operating mode for driving a plurality of LEDs, to ensure a constant current value of a drive current passing through the LEDs, and the LEDs being divided into a plurality of strings, and having a node between every two adjacent strings, characterized in that:

the multi-segment LED driving circuit comprises a plurality of control units, each having a detection part, a comparison part and an adjusting part, and the detection part is electrically coupled to both ends of each string and the next string thereof, and the comparison part is electrically coupled to the detection part and the adjusting part, and the adjusting part is electrically coupled to each string; the detection part detects an input voltage and an output voltage at both ends of each string and the next string thereof to form a detected value, and the comparison part compares the detected value with a reference value to output a driving signal to turn on or off the adjusting part, so as to control the drive current passing through the strings or passing through the strings and the next strings thereof.

8. A multi-segment LED driving circuit, used in an AC operating mode for driving a plurality of LEDs to ensure a constant current value of a drive current passing through the LEDs, and the LEDs being divided into a plurality of strings, and having a node between every two adjacent strings, characterized in that:

the multi-segment LED driving circuit has at least one control chip, and the control chip has a plurality of control units, each having a detection part, a comparison part and an adjusting part, and the detection part is electrically coupled to both ends of each string and the next string thereof, and the comparison part is electrically coupled to the detection part and the adjusting part, and the adjusting part is electrically coupled to each string; and the detection part detects an input voltage and an output voltage at both ends of each string and the next string thereof to form a detected value provided for the comparison part to compare the detected value with a reference value and then output a driving signal to turn on or off the adjusting part, so as to control the drive current passing through the string or passing through the string and the next string thereof.

9. The multi-segment LED driving circuit of claim 8, wherein if there is a plurality of control chips, the control chips are connected in series with each other by a pair of corresponding expansion pins, the quantity of the control chips used is increased or decreased according to the quantity of strings used.

* * * * *